US009429009B2

(12) United States Patent
Paulk et al.

(10) Patent No.: US 9,429,009 B2
(45) Date of Patent: Aug. 30, 2016

(54) METHODS AND SYSTEMS FOR PROVIDING A PACKAGE OF SENSORS TO ENHANCE SUBTERRANEAN OPERATIONS

(75) Inventors: Marty Paulk, Houston, TX (US); Loyd Eddie East, Jr., Tomball, TX (US); Ronald Johannes Dirksen, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 469 days.

(21) Appl. No.: 14/113,434

(22) PCT Filed: Oct. 25, 2011

(86) PCT No.: PCT/US2011/057633

§ 371 (c)(1),
(2), (4) Date: Oct. 23, 2013

(87) PCT Pub. No.: WO2013/062525

PCT Pub. Date: May 2, 2013

(65) Prior Publication Data

US 2014/0041865 A1 Feb. 13, 2014

(51) Int. Cl.

| | |
|---|---|
| ***E21B 47/00*** | (2012.01) |
| ***E21B 21/08*** | (2006.01) |
| ***E21B 44/00*** | (2006.01) |

(52) U.S. Cl.

CPC ..... *E21B 47/00* (2013.01); *E21B 21/08* (2013.01); *E21B 44/00* (2013.01)

(58) Field of Classification Search

CPC ..... E21B 44/00; E21B 21/08; E21B 47/00
See application file for complete search history.

(56) References Cited

U.S. PATENT DOCUMENTS

| | | | | |
|---|---|---|---|---|
| 6,484,816 | B1 * | 11/2002 | Koederitz | E21B 21/08 175/25 |
| 8,636,060 | B2 * | 1/2014 | Hernandez | E21B 21/08 166/250.01 |
| 9,279,298 | B2 * | 3/2016 | Lewis | E21B 21/08 |
| 2003/0063013 | A1 | 4/2003 | Jin et al. | |
| 2004/0182574 | A1 | 9/2004 | Adnan et al. | |
| 2005/0194182 | A1 * | 9/2005 | Rodney | E21B 47/12 175/24 |
| 2007/0030167 | A1 * | 2/2007 | Li | E21B 17/003 340/855.1 |
| 2007/0263488 | A1 * | 11/2007 | Clark | E21B 47/12 367/87 |
| 2008/0041149 | A1 * | 2/2008 | Leuchtenberg | E21B 21/08 73/152.21 |

(Continued)

OTHER PUBLICATIONS

International Search Report and Written Opinion, International Application No. PCT/US2011/057633, 10 pages, Jul. 25, 2012.

*Primary Examiner* — Shane Bomar
(74) *Attorney, Agent, or Firm* — Alan Bryson; Baker Botts L.L.P.

(57) ABSTRACT

A method and system for autonomously enhancing the performance of rig operations at a rig-site, including subterranean operations at a rig-site. The system may include an integrated control system, wherein the integrated control system monitors one or more parameters of sensor units of the rig operations, and a central computer that can communicate with sensor units reporting the health and operational status of the rig operations. The system may further be upgraded by a package of sensors attached to the various tools that allow the central computer an overall synchronized view of the rig operations.

20 Claims, 5 Drawing Sheets

(56) References Cited

U.S. PATENT DOCUMENTS

2008/0135291 A1* 6/2008 Hall ..... E21B 21/08 175/25
2009/0166031 A1* 7/2009 Hernandez ..... E21B 21/08 166/250.01
2009/0225630 A1 9/2009 Zheng et al.
2010/0257926 A1 10/2010 Yamate et al.
2012/0165997 A1* 6/2012 Lewis ..... E21B 44/005 700/282
2013/0008647 A1* 1/2013 Dirksen ..... E21B 21/103 166/250.01

* cited by examiner

METHODS AND SYSTEMS FOR PROVIDING A PACKAGE OF SENSORS TO ENHANCE SUBTERRANEAN OPERATIONS

CROSS-REFERENCE TO RELATED APPLICATION

This application is a U.S. National Stage Application of International Application No. PCT/US2011/057633 filed Oct. 25, 2011, and which is hereby incorporated by reference in its entirety.

BACKGROUND

Hydrocarbons, such as oil and gas, are commonly obtained from subterranean formations. Although systems for monitoring drilling operations are known, these systems fail to provide an efficient method of collecting information from various drilling operations. Generally, a drilling operation conducted at a wellsite requires that a wellbore be drilled that penetrates the hydrocarbon-containing portions of the subterranean formation. Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation.

The performance of various phases of subterranean operations involves numerous tasks that are typically performed by different subsystems located at the well site, or positioned remotely therefrom. Each of these different steps involve a plurality of drilling parameter information provided by one or more information provider units, such as the wireline drum, the managed pressure drilling unit (MPD), underbalanced pressure drilling unit, fluid skid, measurement while drilling (MWD) toolbox, and other such systems. Generally, for operation of a wellsite, it is required that parameters be measured from each of the information provider units at a wellsite.

Traditionally, the data from these information provider units are measured by sensors located at the information provider unit. The data from these sensors are collected at the information provider unit, and transmitted to a storage location on the information provider unit. One or more rig operators may collect such data from the various information provider units. Each of these types of data from the sensors may be located at multiple places, and there is no apparent way to gather the data at a central location for analysis.

However, drilling operations may be impeded if the proper sensors are not deployed on machinery. Additionally, drilling operations may involve a number of different operators from in different portions of a wellbore operation. No consistency exists among the deployment of sensors at a wellbore in connection with a subterranean operation. With the increasing demand for hydrocarbons and the desire to minimize the costs associated with performing subterranean operations, there exists a need for automating the process of data collection and monitoring of the operations by a consistent set of sensors for a wellbore and enhancing the package of sensors available at a wellbore to provide for automation and efficient monitoring and enhancement of rig operations. Additionally, the principles of the present invention are applicable not only during drilling, but also throughout the life of a wellbore including, but not limited to, during logging, testing, completing, and production. If a drilling operator arrives at a site that has already begun drilling operations, there exists a need to deploy a uniform package of sensors to enhance the rig operations to automate the rig operations.

Figure 1:
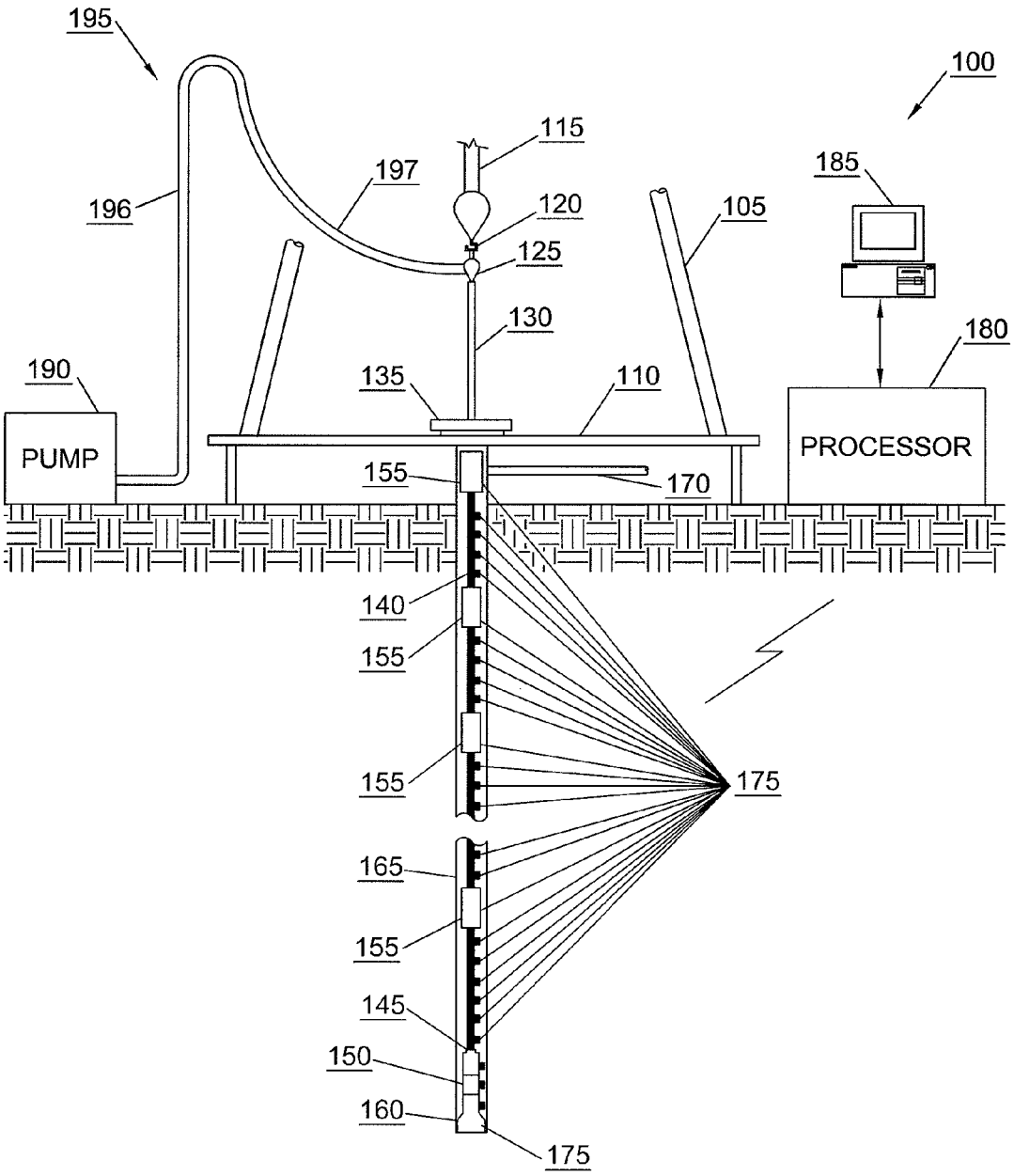
FIG. 1 shows an illustrative system for performing drilling operations.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. Devices and methods in accordance with certain embodiments may be used in one or more of wireline, measurement-while-drilling (MWD) and logging-while-drilling (LWD) operations. "Measurement-while-drilling" is the term generally used for measuring conditions downhole concerning the movement and location of the drilling assembly while the drilling continues. "Logging-while-drilling" is the term generally used for similar techniques that concentrate more on formation parameter measurement.

The terms "couple" or "couples," as used herein are intended to mean either an indirect or direct connection. Thus, if a first device couples to a second device, that connection may be through a direct connection, or through an indirect electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

The present invention is directed to improving efficiency of subterranean operations and more specifically, to a method and system for enhancing subterranean operations by providing a package of sensors to automate data collection.

As shown in FIG. 1, oil well drilling equipment 100 (simplified for ease of understanding) may include a derrick 105, derrick floor 110, draw works 115 (schematically represented by the drilling line and the traveling block), hook 120, swivel 125, kelly joint 130, rotary table 135, drillpipe 140, one or more drill collars 145, one or more MWD/LWD tools 150, one or more subs 155, and drill bit 160. Drilling fluid is injected by a mud pump 190 into the swivel 125 by a drilling fluid supply line 195, which may include a standpipe 196 and kelly hose 197. The drilling fluid travels through the kelly joint 130, drillpipe 140, drill collars 145, and subs 155, and exits through jets or nozzles in the drill bit 160. The drilling fluid then flows up the annulus between the drillpipe 140 and the wall of the borehole 165. One or more portions of borehole 165 may comprise an open hole and one or more portions of borehole 165 may be cased. The drillpipe 140 may be comprised of multiple drillpipe joints. The drillpipe 140 may be of a single nominal diameter and weight (i.e., pounds per foot) or may comprise intervals of joints of two or more different nominal diameters and weights. For example, an interval of heavy-weight drillpipe joints may be used above an interval of lesser weight drillpipe joints for horizontal drilling or other applications. The drillpipe 140 may optionally include one or more subs 155 distributed among the drillpipe joints. If one or more subs 155 are included, one or more of the subs 155 may include sensing equipment (e.g., sensors), communications equipment, data-processing equipment, or other equipment. The drillpipe joints may be of any suitable dimensions (e.g., 30 foot length). A drilling fluid return line 170 returns drilling fluid from the borehole 165 and circulates it to a drilling fluid pit (not shown) and then the drilling fluid is ultimately recirculated via the mud pump 190 back to the drilling fluid supply line 195. The combination of the drill collar 145, Measurement While Drilling ("MWD")/Logging While Drilling ("LWD") tools 150, and drill bit 160 is known as a bottomhole assembly (or "BHA"). The BHA may further include a bit sub, a mud motor (discussed below), stabilizers, jarring devices and crossovers for various threadforms. The mud motor operates as a rotating device used to rotate the drill bit 160. The different components of the BHA may be coupled in a manner known to those of ordinary skill in the art, such as, for example, by joints. The combination of the BHA, the drillpipe 140, and any included subs 155, is known as the drill string. In rotary drilling, the rotary table 135 may rotate the drill string, or alternatively the drill string may be rotated via a top drive assembly.

One or more force sensors 175 may measure one or more force components, such as axial tension or compression, or torque, along the drillpipe. One or more force sensors 175 may be used to measure one or more force components reacted to by or consumed by the borehole, such as borehole-drag or borehole-torque, along the drillpipe. One or more force sensors 175 may be used to measure one or more other force components such as pressure-induced forces, bending forces, or other forces. One or more force sensors 175 may be used to measure combinations of forces or force components. In certain implementations, the drill string may incorporate one or more sensors to measure parameters other than force, such as temperature, pressure, or acceleration.

In one example implementation, one or more force sensors 175 are located on or within the drillpipe 140. Other force sensors 175 may be on or within one or more drill collars 145 or the one or more MWD/LWD tools 150. Still other force sensors 175 may be in built into, or otherwise coupled to, the bit 160. Still other force sensors 175 may be disposed on or within one or more subs 155. One or more force sensors 175 may provide one or more force or torque components experienced by the drill string at surface. In one example implementation, one or more force sensors 175 may be incorporated into the draw works 115, hook 120, swivel 125, or otherwise employed at surface to measure the one or more force or torque components experienced by the drill string at the surface.

In one example implementation, one or more force sensors 175 are located on or within the drillpipe 140. Other force sensors 175 may be on or within one or more drill collars 145 or the one or more MWD/LWD tools 150. Still other force sensors 175 may be in built into, or otherwise coupled to, the bit 160. Still other force sensors 175 may be disposed on or within one or more subs 155. One or more force sensors 175 may provide one or more force or torque components experienced by the drill string at surface. In one example implementation, one or more force sensors 175 may be incorporated into the draw works 115, hook 120, swivel 125, or otherwise employed at surface to measure the one or more force or torque components experienced by the drill string at the surface.

The one or more force sensors 175 may be coupled to portions of the drill string by adhesion or bonding. This adhesion or bonding may be accomplished using bonding agents such as epoxy or fasters. The one or more force sensors 175 may experience a force, strain, or stress field related to the force, strain, or stress field experienced proximately by the drill string component that is coupled with the force sensor 175.

Other force sensors 175 may be coupled so as to not experience all, or a portion of, the force, strain, or stress field experienced by the drill string component coupled proximate to the force sensor 175. Force sensors 175 coupled in this manner may, instead, experience other ambient conditions, such as one or more of temperature or pressure. These force sensors 175 may be used for signal conditioning, compensation, or calibration.

The force sensors 175 may be coupled to one or more of: interior surfaces of drill string components (e.g., bores), exterior surfaces of drill string components (e.g., outer diameter), recesses between an inner and outer surface of drill string components. The force sensors 175 may be coupled to one or more faces or other structures that are orthogonal to the axes of the diameters of drill string components. The force sensors 175 may be coupled to drill string components in one or more directions or orientations relative to the directions or orientations of particular force components or combinations of force components to be measured.

In certain implementations, force sensors 175 may be coupled in sets to drill string components. In other implementations, force sensors 175 may comprise sets of sensor devices. When sets of force sensors 175 or sets of sensor devices are employed, the elements of the sets may be coupled in the same, or different ways. For example, the elements in a set of force sensors 175 or sensor devices may have different directions or orientations, relative to each other. In a set of force sensors 175 or a set of sensor devices, one or more elements of the set may be bonded to experience a strain field of interest and one or more other elements of the set (i.e., "dummies") may be bonded to not experience the same strain field. The dummies may, however, still experience one or more ambient conditions. Elements in a set of force sensors 175 or sensor devices may be symmetrically coupled to a drill string component. For example three, four, or more elements of a set of sensor devices or a set of force sensors 175 may spaced substantially equally around the circumference of a drill string component. Sets of force sensors 175 or sensor devices may be used to: measure multiple force (e.g., directional) components, separate multiple force components, remove one or more force components from a measurement, or compensate for factors such as pressure or temperature. Certain example force sensors 175 may include sensor devices that are primarily unidirectional. Force sensors 175 may employ commercially available sensor device sets, such as bridges or rosettes.

The force sensors 170 may be powered from a central bus or battery powered by, for example, a small watch size lithium battery. The force sensors 170 may be hydraulically ported to the annulus outside the drillpipe. The force sensors 170 may be ported to the interior of the drillpipe. The force sensors 170 may be strain gauge type, quartz crystal, fiber optical, or other sensors to convert pressures to signals. The force sensors 170 may be easily oriented perpendicular to the streamlines of the flow, to measure static pressures. The sensor may also be oriented to face, or partially face, into the flow (e.g. an extended pivot tube approach or a shallow ramping port). In such an arrangement the force sensors 170 may measure the stagnation pressure.

Figure 2:
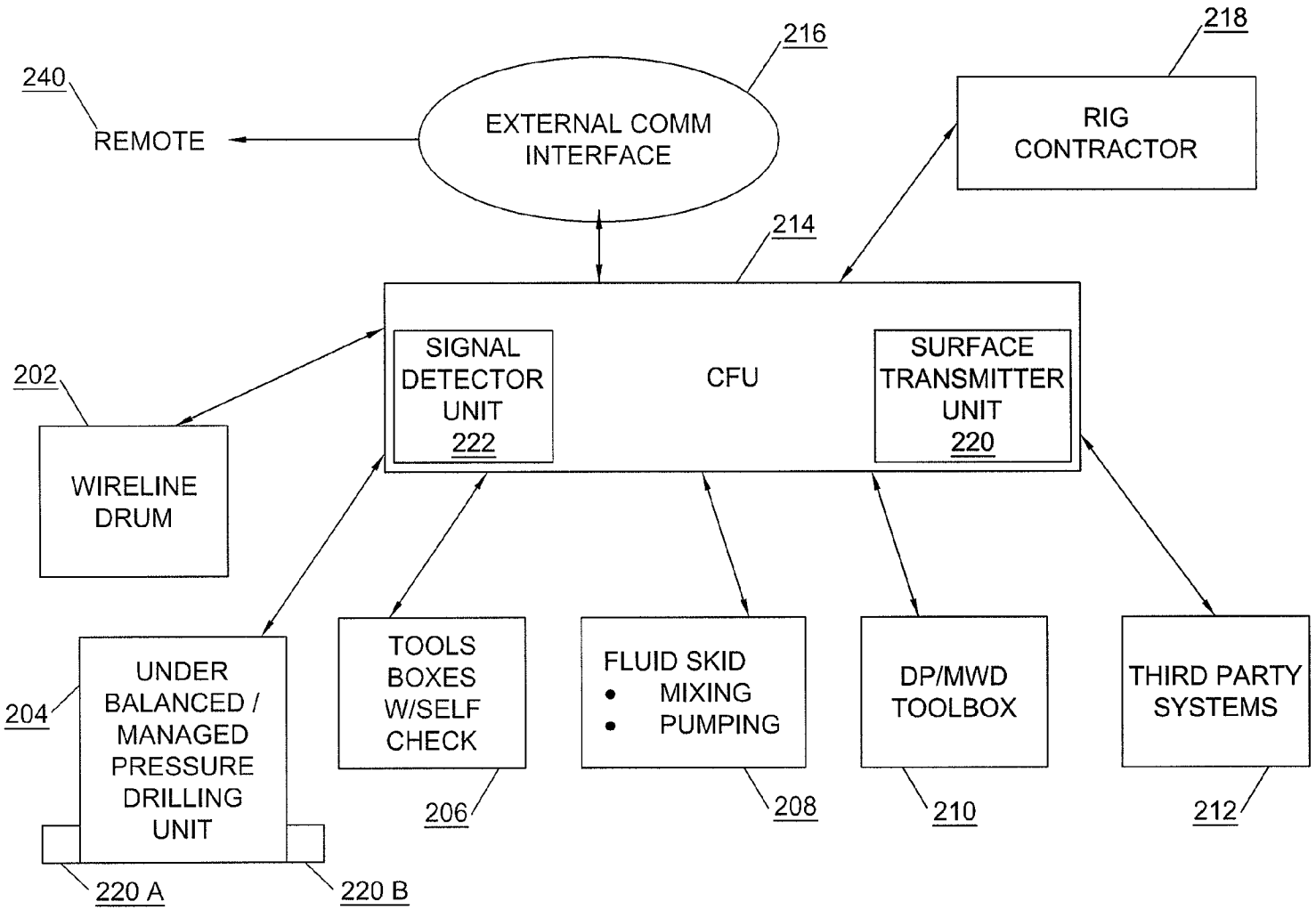
FIG. 2 shows a centralized functional unit in accordance with an exemplary embodiment of the present invention.

FIG. 2 discloses a central monitoring system implemented by a central functional unit 214. The system may contain one or more functional units at the rig site that require monitoring. The functional units may include one or more of a wireline drum 202, underbalanced/managed pressure unit 204, tool boxes containing self-check 206, fluid skid 208, including mixing and pumping units, and measurement while drilling toolbox 210. The functional units may include third party functional units 212.

Each functional unit may be communicatively coupled to the CFU 214. For some embodiments of the invention, the CFU 214 may provide an interface to one or more suitable integrated drive electronics drives, such as a hard disk drive (HDD) or compact disc read only memory (CD ROM) drive, or to suitable universal serial bus (USB) devices through one or more USB ports. In certain embodiments, the CFU 214 may also provide an interface to a keyboard, a mouse, a CD-ROM drive, and/or one or more suitable devices through one or more firewire ports. For certain embodiments of the invention, the CFU may also provide a network interface through which CFU can communicate with other computers and/or devices.

In one embodiment, the CFU 214 may be a Centralized Data Acquisition System. In certain embodiments, the connection may be an Ethernet connection via an Ethernet cord. As would be appreciated by those of ordinary skill in the art, with the benefit of this disclosure, the functional units may be communicatively coupled to the CFU 214 by other suitable connections, such as, for example, wireless, radio, microwave, or satellite communications. Such connections are well known to those of ordinary skill in the art and will therefore not be discussed in detail herein. In one exemplary embodiment, the functional units could communicate bidirectionally with the CFU 214. In another embodiment, the functional units could communicate directly with other functional units employed at the rigsite.

In one exemplary embodiment, communication between the functional units may be by a common communication protocol, such as the Ethernet protocol. For functional units that do not communicate in the common protocol, a converter may be implemented to convert the protocol into a common protocol used to communicate between the functional units. With a converting unit, a third party such as a Rig Contractor 218, may have their own proprietary system communicating to the CFU 214. Another advantage of the present invention would be to develop a standard data communication protocol for adding new parameters.

The CFU 214 may be implemented in a software on a common central processing unit (CPU) for performing the functions of the CFU 214 in software. In one embodiment, the functional units may record data in such a manner that the CFU 214 using software can track and monitor all of the functional units. The data will be stored in a database with a common architecture, such as, for example, oracle, SQL, or other type of common architecture.

The data from the functional units may be generated by sensors 220A and 220B, which may be coupled to appropriate data encoding circuitry, such as an encoder, which sequentially produces encoded digital data electrical signals representative of the measurements obtained by sensors 220A and 220B. While two sensors are shown, one skilled in the art will understand that a smaller or larger number of sensors may be used without departing from the scope of the present invention. The sensors 220A and 220B may be selected to measure downhole parameters including, but not limited to, environmental parameters, directional drilling parameters, and formation evaluation parameters. Such parameters may include downhole pressure, downhole temperature, the resistivity or conductivity of the drilling mud and earth formations. Such parameters may include downhole pressure, downhole temperature, the resistivity or conductivity of the drilling mud and earth formations, the density and porosity of the earth formations, as well as the orientation of the wellbore. Sensor examples include, but are not limited to: a resistivity sensor, a nuclear porosity sensor, a nuclear density sensor, a magnetic resonance sensor, and a directional sensor package. Additionally, formation fluid samples and/or core samples may be extracted from the formation using formation tester. Such sensors and tools are known to those skilled in the art. In an embodiment, the sensors may be based on a standard hardware interface that could add new sensors for measuring new metrics at the rigsite in the system.

In one example, data representing sensor measurements of the parameters discussed above may be generated and stored in the CFU 214. Some or all of the data may be transmitted by data signaling unit. For example, an exemplary function unit, such as an underbalanced/managed pressure drilling unit 204 may provide data in a pressure signal traveling in the column of drilling fluid to the CFU 214 may be detected at the surface by a signal detector unit 222 employing a pressure detector in fluid communication with the drilling fluid. The detected signal may be decoded in CFU 214. In one embodiment, a downhole data signaling unit is provided as part of the MPD unit 204. Data signaling unit may include a pressure signal transmitter for generating the pressure signals transmitted to the surface. The pressure signals may include encoded digital representations of measurement data indicative of the downhole drilling parameters and formation characteristics measured by sensors 220A and 220B. Alternatively, other types of telemetry signals may be used for transmitting data from downhole to the surface. These include, but are not limited to, electromagnetic waves through the earth and acoustic signals using the drill string as a transmission medium. In yet another alternative, drill string may include wired pipe enabling electric and/or optical signals to be transmitted between downhole and the surface. In one example, CFU 214 may be located proximate the rig floor. Alternatively, CFU 214 may be located away from the rig floor. In certain embodiments, a surface transmitter 220 may transmit commands and information from the surface to the functional units. For example, surface transmitter 220 may generate pressure pulses into the flow line that propagate down the fluid in drill string, and may be detected by pressure sensors in MPD unit 204. The information and commands may be used, for example, to request additional downhole measurements, to change directional target parameters, to request additional formation samples, and to change downhole operating parameters.

In addition, various surface parameters may also be measured using sensors located at functional units 202 . . . 212. Such parameters may include rotary torque, rotary RPM, well depth, hook load, standpipe pressure, and any other suitable parameter of interest.

Any suitable processing application package may be used by the CFU 214 to process the parameters. In one embodiment, the software produces data that may be presented to the operation personnel in a variety of visual display presentations such as a display. In certain example system, the measured value set of parameters, the expected value set of parameters, or both may be displayed to the operator using the display. For example, the measured-value set of parameters may be juxtaposed to the expected-value set of parameters using the display, allowing the user to manually identify, characterize, or locate a downhole condition. The sets may be presented to the user in a graphical format (e.g., a chart) or in a textual format (e.g., a table of values). In another example system, the display may show warnings or other information to the operator when the central monitoring system detects a downhole condition.

The operations will occur in real-time and the data acquisition from the various functional units need to exist. In one embodiment of data acquisition at a centralized location, the data is pushed at or near real-time enabling real-time communication, monitoring, and reporting capability. This allows the collected data to be used in a streamline workflow in a real-time manner by other systems and operators concurrently with acquisition.

As shown in FIG. 2, in one exemplary embodiment, the CFU 214 may be communicatively coupled to an external communications interface 216. The external communications interface 216 permits the data from the CFU 214 to be remotely accessible by any remote information handling system communicatively coupled to the remote connection 140 via, for example, a satellite, a modem or wireless connections. In one embodiment, the external communications interface 216 may include a router.

In accordance with an exemplary embodiment of the present invention, once feeds from one or more functional units are obtained, they may be combined and used to identify various metrics. For instance, if there is data that deviates from normal expectancy at the rig site, the combined system may show another reading of the data from another functional unit that may help identify the type of deviation. For instance, if a directional sensor is providing odd readings, but another sensor indicates that the fluid is being pumped nearby, that would provide a quality check and an explanation for the deviation. As would be appreciated by those of ordinary skill in the art, with the benefit of this disclosure, a CFU 214 may also collect data from multiple rigsites and wells to perform quality checks across a plurality of rigsites.

Figure 3:
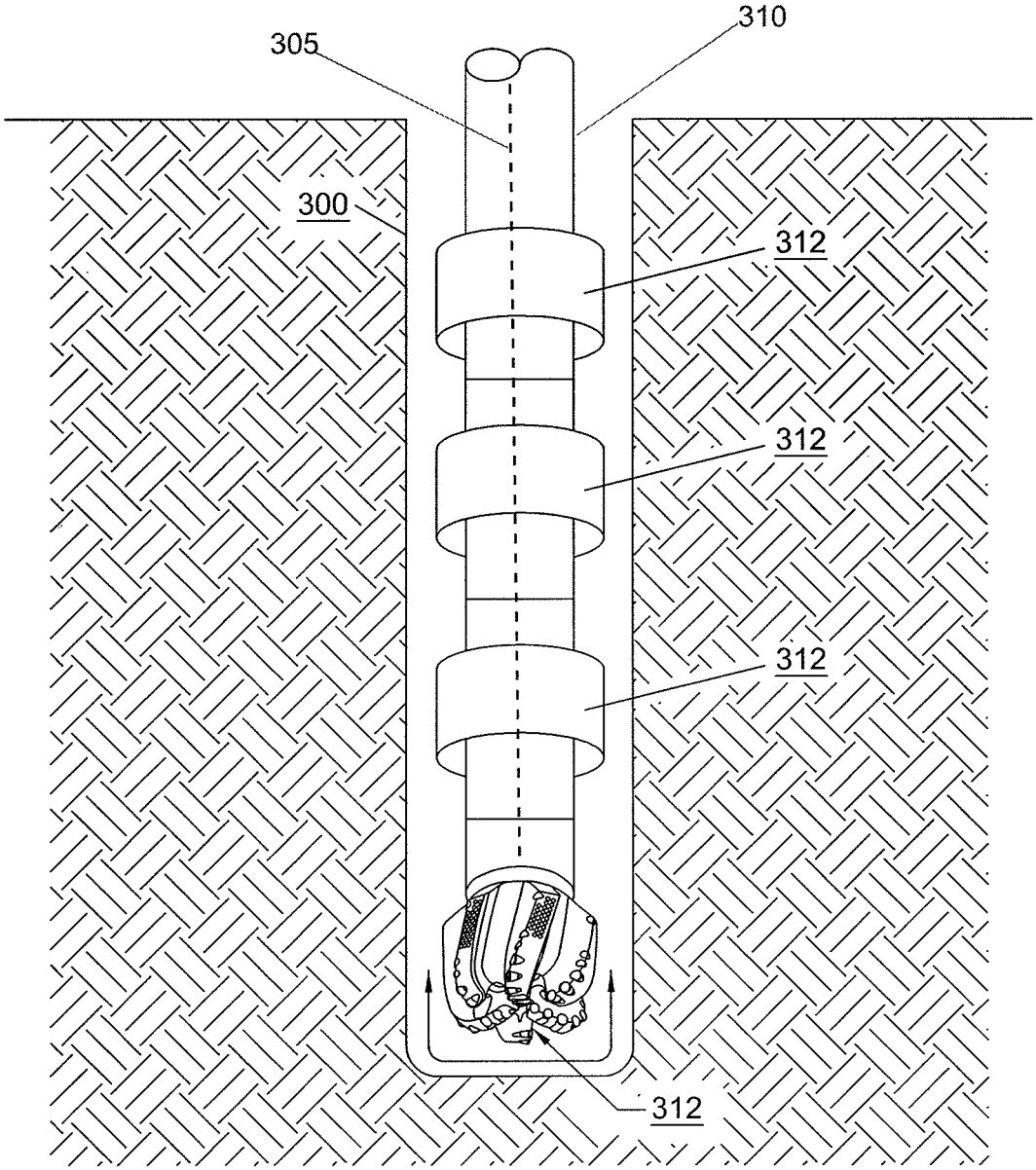
FIG. 3 shows a downhole functional unit equipped in accordance with an embodiment of the present invention.

FIG. 3 is an exemplary embodiment of a bottom hole assembly 300 with the enhanced package of sensors in accordance with the present invention. Example sensor package may include, for example, sensors that measure drill string depth, pipe weight, rate of penetration, drag, rotation speed, and vibration including bitchatter from a drillbit. The sensors 312 are only illustrative are not intended to limit the scope of the invention. Traditionally, the group responsible for implementing this portion may not have included each of the sensors to enhance the rig package. With this implementation, the present rig operations can be enhanced by a sensor package that can address each parameter desired. The sensors would be attached to the downhole equipment as well. For example, sensors may be included to measure flow meters, pressure, and fluid density. With the deployment of a common sensor package, wellbore operations can be further enhanced as every wellbore operation will have the ability to measure the same type of parameters. This would prevent the necessity for separately bringing out sensing or measuring tools to inquire about parameters on as needed basis.

In one aspect, a sensor package may house any suitable sensor, including a weight sensor, torque sensors, sensor for determining vibrations, oscillations, bending, stick-slip, whirl, etc. In one aspect, the sensors may be disposed on a common sensor body. Conductors may be used to transmit signals from the sensor package to a circuit, which may further include a processor to process sensor signals according to programmed instructions accessible to the processor. The sensor signals may be sent to the integrated control unit connected for all of the sensors in the drilling assembly and wellbore. Example Halliburton directional sensors include, for example, DM (Directional Module, PCD (Pressure Case Directional) and PM3 (Position Monitor). Other sensors may include the azimuthal deep resistivity (ADR) sensors, the azimuthal focus resistivity (AFR) sensors, and the IXO, included within the InSite package of sensors.

Signals from sensors 312 are coupled to communications medium 305, which is disposed in drillpipe 310. In one example system, the communications medium 305 may be located within an inner annulus of drillpipe 310. In another example system, the drillpipe 310 may have a gun-drilled channel though the length of the drillpipe 310. In such a drillpipe 310, the communications medium 305 may be place in the gun-drilled channel.

The communications medium 305 can be a wire, a cable, a waveguide, a fiber, or any other medium that allows high data rates. The communications medium 305 may be a single communications path or it may be more than one. For example, one communications path may connect one or more of the sensors 312 to the central functional unit 214, while another communications path may connect another one or more sensors 170 to another functional unit.

Returning to FIG. 1, the force sensors 170 communicate with a central functional unit 214 through the communications medium 305. Communications over the communications medium 305 can be in the form of network communications, using, for example Ethernet, with each of the sensor modules being addressable individually or in groups. Alternatively, communications can be point-to-point. Whatever form it takes, the communications medium 235 may provide high-speed data communication between the sensors in the bit 160 and the central functional unit 214. The communications medium 305 may permit communications at a speed sufficient to allow the central functional unit 214 to perform real-time collection and analysis of data from force sensors 170.

Figure 4:
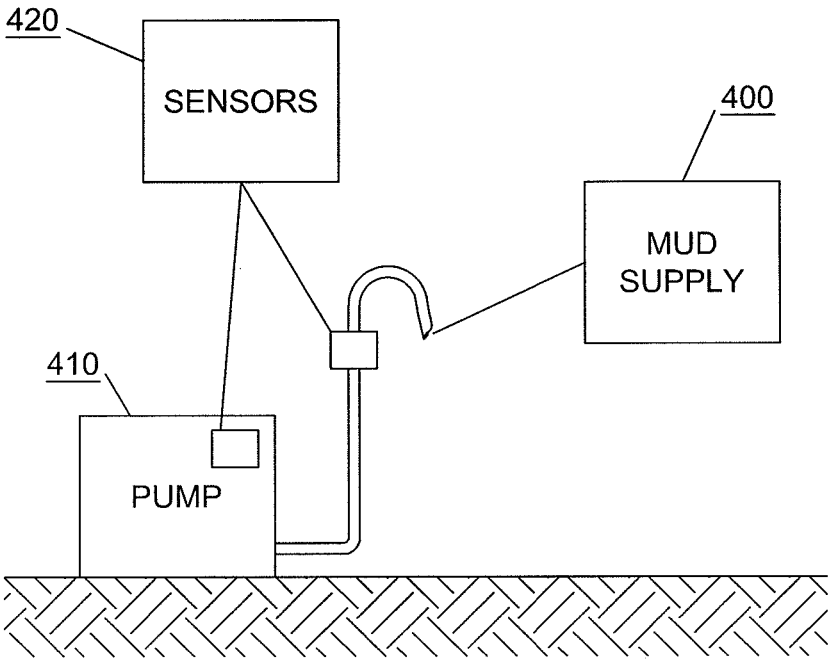
FIG. 4 depicts another example of a functional unit equipped in accordance with an embodiment of the present invention.

FIG. 4 is another embodiment of enhancing operations of a bottom hole assembly regarding mud circulation. The mud supply circulation system 400 of FIG. 4, in an exemplary embodiment, typically part of the bottom hole assembly maintains the circulation system of drilling mud (typically, mixture of water, clay, weighting material and chemicals, used to lift rock cuttings form the drill bit to the surface) under pressure through the kelly, rotary table, drill pipes and drill collars. The pump 410 sucks mud from the mud pits and pumps it to the drilling apparatus. The pipes and hoses connect the pump 410 to the drilling apparatus. The mud-return line returns mud from the hole. The shale shaker separates rock cuttings from the mud. The shale slide conveys cuttings to the reserve pit. The reserve pit collects rock cuttings separated from the mud. The mixing apparatus is known to one of ordinary skill in the art. Typically, monitoring the circulation system for the mud supply is a critical component of the subterranean operation. FIG. 4 implements the present invention an embodiment by including sensors 420 within the circulation system to provide an autonomous data collection mechanism and enhance rig operations. The mud supply can be enhanced by including sensors for density, temperature, and viscosity, but are not listed to limit such sensors, and are only identified as some of the examples of the various types of sensors that may enhance the operations known to a person of ordinary skill in the art. The sensor packages replace the standard installation at the wellbore pertaining to the subterranean operations. The sensors can be deployed on a mudpump or along the fluid supply line.

The information from the sensors can be collected by a centralized data acquisition system 214 of FIG. 2 that can remotely communicate with various systems.

Figure 5:
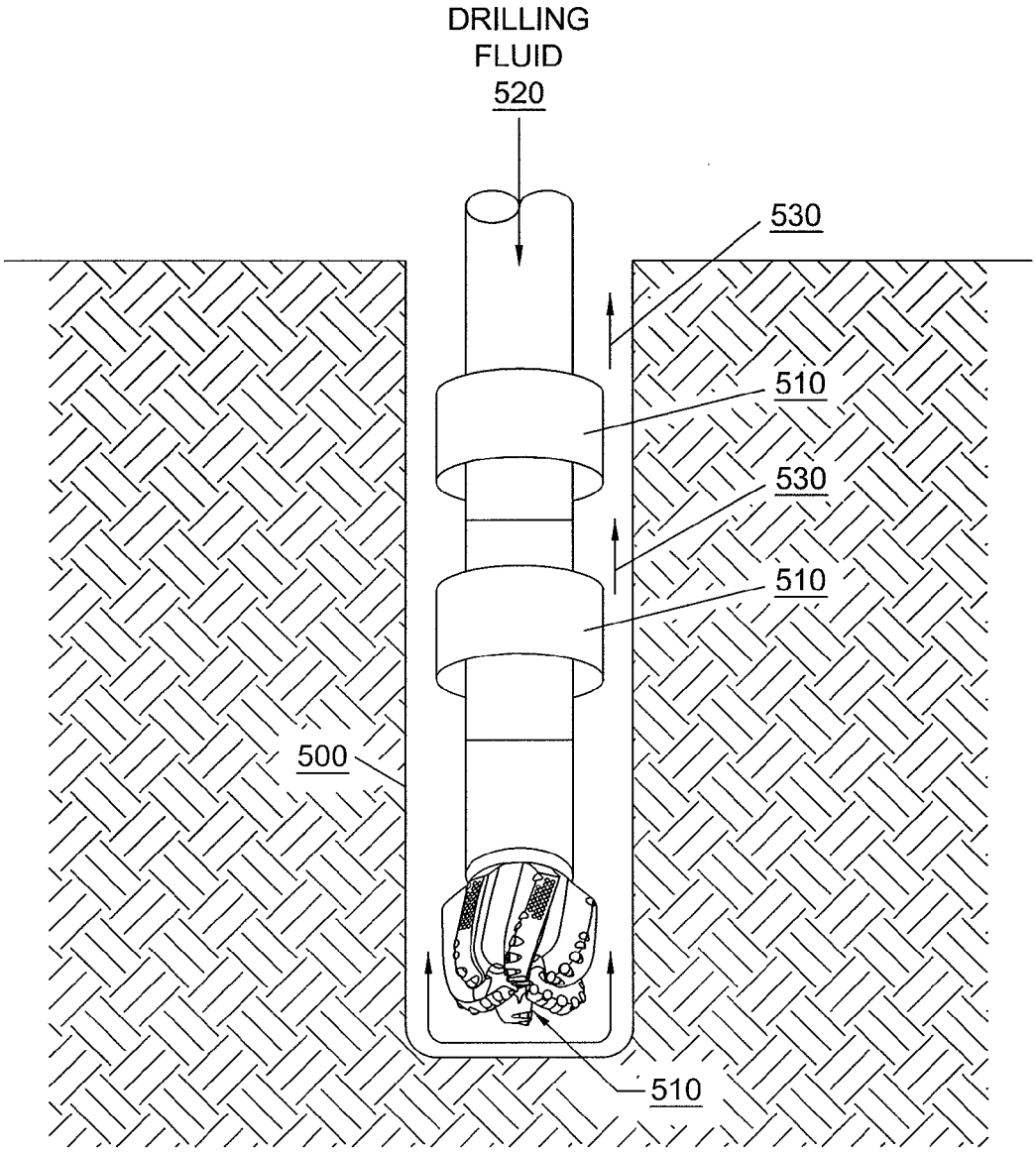
FIG. 5 depicts an enhanced sensor package for an exemplary embodiment of the drillpipe of the bottom home assembly.

Additional sensors may also be placed to measure the return flow of the drilling fluid as shown in an exemplary embodiment of the present invention at FIG. 5. In FIG. 5, the casing 500 is displayed with sensors 510 across the region for the return flow to analyze the operation of the drilling fluid 520 through the bottom hole assembly and drilling process. FIG. 5 is an example implementation of a sensor package for a return flow to enhance drilling operations.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in foam and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. An integrated system for enhancing the performance of subterranean operations comprising:

an integrated control system;

wherein the integrated control system monitors one or more subterranean operations;

wherein the integrated control system comprises a centralized functional unit communicatively coupled to one or more functional units that require monitoring;

wherein the one or more functional units record data;

wherein the centralized functional unit monitors the one or more functional units based, at least in part, on the recorded data;

a package of sensors, wherein the package of sensors comprises a plurality of sensors, and wherein the plurality of sensors comprises at least two different types of sensors; and wherein the package of sensors is communicatively coupled to at least one of the one or more functional units, wherein the centralized function unit receives data from the package of sensors corresponding to the at least one of the one or more functional units.

2. The system of claim 1, wherein the one or more functional units are selected from the group consisting of a Wireline drum, an underbalanced/managed pressure drilling unit, a tool boxes containing self-check, a fluid skid, and a measurement while drilling toolbox.

3. The system of claim 1, wherein the one or more functional units communicate with the integrated control system through a common communication protocol.

4. The system of claim 1, wherein the centralized functional unit is communicatively coupled to a remote information handling system.

5. The system of claim 1, wherein the centralized functional unit processes information received from the one or more functional units via the package of sensors, and wherein the centralized functional unit uses the processed information to monitor the subterranean operations.

6. The system of claim 1, wherein the package of sensors is deployed on a mud supply to enhance the subterranean operations.

7. The system of claim 1, wherein the package of sensors is deployed to monitor a return flow.

8. A method for enhancing the performance of subterranean operations comprising:

providing a package of sensors that enhance the performance of subterranean operations, wherein the package of sensors are communicatively coupled to one or more functional units that require monitoring, wherein the package of sensors comprises a plurality of sensors, and wherein the plurality of sensors comprise at least two different types of sensors;

receiving data relating to a subterranean operation from at least one sensor of the package of sensors corresponding to one or more functional units, wherein the function units are communicatively coupled to an integrated control system comprising a centralized function unit; and recording the data by the one or more functional units;

monitoring, by the centralized function unit, the one or more functional units based, at least in part, on the recorded data.

9. The method of claim 8, wherein the one or more functional units are selected from the group consisting of a Wireline drum, an underbalanced/managed pressure drilling unit, a tool boxes containing self-check, a fluid skid, and a measurement while drilling toolbox.

10. The method of claim 8, wherein the one or more functional units communicate with the integrated control system through a common communication protocol.

11. The method of claim 8, wherein the centralized functional unit is communicatively coupled to a remote information handling system.

12. The method of claim 8, further comprising processing the data received from the one or more functional units and using the processed data to monitor the subterranean operations.

13. The method of claim 8, wherein the package of sensors is deployed on a mudsupply to enhance the subterranean operations.

14. The method of claim 8, wherein the package of sensors is deployed to monitor a return flow.

15. An integrated subterranean operation control system for enhancing the performance of subterranean operations comprising:

an integrated control system comprising a centralized data acquisition server communicatively coupled to one or more functional units that require monitoring;

wherein the one or more functional units record data;

wherein the centralized data acquisition server monitors the one or more functional units based, at least in part, on the recorded data;

a package of sensors, wherein the package of sensors is communicatively coupled to at least one of the one or more functional units to enhance subterranean operations, wherein the package of sensors comprises a plurality of sensors, wherein the plurality of sensors comprises at least two different types of sensors, and wherein the centralized data acquisition server receives the data from at least one sensor of the package of sensors communicatively coupled to one or more functional units.

16. The system of claim 15, further comprising a bottom hole assembly, wherein a mud supply is enhanced by the package of sensors, wherein the bottom hole assembly provides uniform data regarding its operations.

17. The system of claim 15, wherein the one or more functional units communicate with the integrated control system through a common communication protocol.

18. The system of claim 15, wherein the package of sensors is associated with a mud flow, and wherein at least one sensor of the package of sensors associated with the mud flow comprises one or more of a density sensor, a temperature sensor, or a viscosity sensor.

19. The system of claim 15, wherein the package of sensors is associated with a bottom hole assembly, and wherein at least one sensor of the package of sensors associated with the bottom hole assembly comprises one or more of a density sensor, a temperature sensor, or a viscosity sensor.

20. The system of claim 15, wherein the package of sensors is associated with a return flow, and wherein at least one sensor of the package of sensors associated with the return flow comprises one or more of a density sensor, a temperature sensor, or a viscosity sensor.

* * * * *